US005179841A

United States Patent [19]

Phillips et al.

[11] Patent Number: 5,179,841

[45] Date of Patent: Jan. 19, 1993

[54] HEAT RECLAMATION FROM AND ADJUSTMENT OF DEFROST CYCLE

[75] Inventors: Thomas R. Phillips, Cicero; Thomas L. Dewolf, Liverpool; Ronald W. Bench, Cicero, all of N.Y.

[73] Assignee: Carrier Corporation, Syracuse, N.Y.

[21] Appl. No.: 673,447

[22] Filed: Mar. 22, 1991

[51] Int. Cl.[5] ..... F25B 41/00

[52] U.S. Cl. ..... 62/81; 62/155; 62/156; 62/234

[58] Field of Search ..... 62/81, 155, 156, 160, 62/234, 278, 324.5

[56] References Cited

U.S. PATENT DOCUMENTS 4,400,949 8/1983 Kinoshita et al. ..... 62/156 X 4,916,912 4/1990 Levine et al. ..... 62/155 X

*Primary Examiner*—Albert J. Makay

*Assistant Examiner*—John Sollecito

[57] ABSTRACT

A adjustable defrost cycle for a heat pump system which ensures that the outdoor coil is maintained free of frost by adjusting a defrost initiation reference level for the initiation of the next subsequent defrost cycle depending upon the time period of the previous defrost cycle.

6 Claims, 3 Drawing Sheets

HEAT RECLAMATION FROM AND ADJUSTMENT OF DEFROST CYCLE

BACKGROUND OF THE INVENTION

1. Field of the Invention

This invention relates generally to heat pump systems, and more particularly to an apparatus and a method for controlling heat reclamation after termination of a defrost cycle, and for adjusting how long each subsequent defrost cycle operates by adjusting when to initiate each subsequent defrost, so that the defrost cycle terminates only when the coil is free from frost.

2. Prior Art

Air conditioners, refrigerators and heat pumps produce a controlled heat transfer by the evaporation of a liquid refrigerant under appropriate pressure conditions in a heat exchanger to produce desired evaporator temperatures. The liquid refrigerant flowing through the heat exchanger removes heat from the medium being cooled and in this process is converted into a vapor at the same pressure and temperature. This vapor then flows into a compressor wherein its temperature and pressure are increased. The high pressure vapor then is conducted to a separate heat exchanger serving as a condenser wherein the gaseous refrigerant gives up heat to a heat transfer fluid in heat exchange relation therewith and changes state from a gas to a high pressure liquid. The high pressure liquid is then supplied to an expansion device which acts to reduce the pressure of the liquid refrigerant such that the liquid refrigerant may flow to the evaporator to begin the cycle again.

During the heating mode, a heat pump circuit utilizes an outdoor heat exchanger serving as an evaporator wherein the evaporator may be located in ambient air at a temperature below the freezing point of water. Thus, as this cold air is circulated over the heat exchanger, water vapor in the air is condensed and frozen on the surfaces of the heat exchanger. As the frost accumulates on the heat exchanger a layer of ice is built up between the portion of the heat exchanger carrying refrigerant and the air flowing thereover. This layer of ice acts as an insulating layer inhibiting the heat transfer in the coil between refrigerant and air. Additionally, on coils having fins to enhance heat transfer, the ice may serve to block the narrow air flow passageways between fins. This additional effect further serves to reduce heat transfer since lesser amounts of air will be circulated in heat exchanger relation with the refrigerant carrying conduits.

To efficiently operate a heat pump under conditions of relatively low outdoor ambient air temperatures it is necessary to provide apparatus for removing the accumulated frost. Many conventional methods are known such as supplying electric resistance heat, reversing the heat pump such that the evaporator becomes a condenser or other refrigerant circuiting techniques to direct hot gaseous refrigerant directly to the frosted heat exchanger.

Many of these defrost techniques utilize energy that is not effectively used for transferring heat energy to a space to be conditioned or to another end use served by the entire system. To reduce the amount of heat energy wasted or otherwise consumed in the defrost operation it is desirable to utilize a defrost system which adjusts the initiation and length of a defrost so that defrost lasts only for the time necessary to remove all frost, and subsequent to a defrost cycle reclaims a portion of the heat energy used in defrost to heat the space.

Different types of control systems have been utilized for adjusting the length of a defrost. A combination of a timer and a thermostat may be used to determine a period of a defrost. The thermostat periodically checks to see whether or not the evaporator temperature or a temperature dependent thereon is below a selected level, and if so acts to place the system in defrost for a period of time dependent on the timer. Other types of prior art defrost initiation systems have included measuring infrared radiation emitted from the fins of the refrigerant carrying coil, measuring the air pressure differentials of the air flow flowing through the heat exchanger, utilizing an electrical device placed on the fin whose characteristics change depending on the temperature of the device, optical-electrical methods and other methods involving the monitoring of various electrical parameters.

A disadvantage of the prior defrost modes is that they do not take into account changes in ambient temperature which can change the frost built-up on a coil between defrosts, nor do they attempt to reclaim the energy used in a defrost.

Thus, there is a clear need for a defrost system that adjusts the initiation of defrost in response to environmental conditions to optimize the length of a defrost, and also reclaims heat from the outdoor coil after the defrost cycle for use in heating the space being conditioned.

SUMMARY OF THE INVENTION

It is an object of the present invention to provide an improved defrost control which adjusts the length of subsequent defrosts to a predetermined optimized period.

It is a further object of the present invention to provide a method of operating a defrost mode for an air conditioning or a refrigeration circuit to ensure the coil is maintained completely free of frost.

It is a another object of the present invention to provide defrost control method which reclaims a portion of the heat of defrost to maximize the efficiency of a complete heating and defrost cycle of operation.

It is still another object of the present invention to provide a method and apparatus of utilizing an adjustable temperature envelope within which the defrost mode is initiated.

In accordance with the present invention, these and other objects are attained by a method and apparatus for measuring the time an outdoor coil of a heat pump system is in the defrost mode and adjusting a first linear part of a defrost initiation curve so that the next subsequent defrost is initiated to optimize the length of time in defrost whereby the coil is completely free of frost within the adjusted length of time of defrost, and heat is reclaimed from the outdoor coil after defrost is terminated, for space heating.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification, and in which reference numerals shown in the drawings designate like or corresponding parts throughout the same, and in which.

DESCRIPTION OF THE PREFERRED EMBODIMENT

Figure 1:
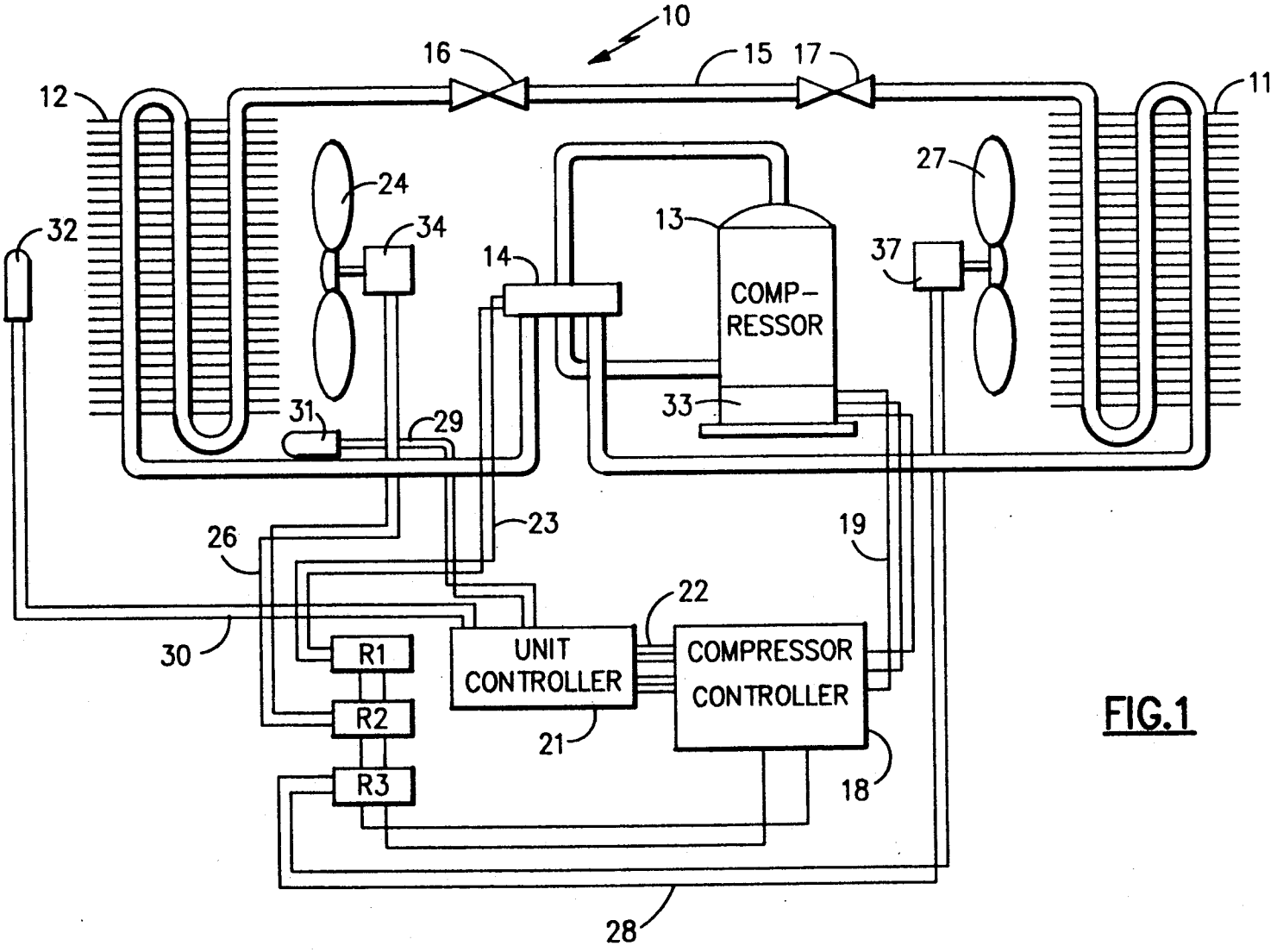
FIG. 1 is a schematic illustration of a heat pump system having the present invention incorporated therein.

Referring now to FIG. 1, there is shown a heat pump system 10 comprising an indoor coil 11, and outdoor coil 12, a compressor 13 and a reversing valve 14. Installed in the line 15 between the indoor and outdoor coils 11 and 12, are bi-flow expansion valves 16 and 17, each having provisions for bypassing refrigerant when it is not acting as an expansion device, thus allowing refrigerant to flow in either direction through the expansion valves depending upon the heating or cooling mode. All of these components operate in a rather conventional heat pump manner to provide cooling to the indoor space while operating in the air conditioning mode and heating to the indoor space while operating in a heating mode.

Although the present invention is equally applicable to either constant speed or variable speed systems, it will presently be described with reference to a constant speed system. Such a system contemplates the use of multi-speed motors such as, for example, a two speed compressor motor. The motor 33 drives the compressor 13, which is normally located in the outdoor section near the outdoor coil 12, the motor 37 drives the fan 27 for the indoor coil 11, and the motor 34 drives the outdoor fan 24 for outdoor coil 12. A compressor controller 18 is therefore provided to communicate with and to coordinate the operation of the reversing valve, the compressor and the associated equipment.

The controller 18 is electrically connected to the compressor motor 33 by leads 19 and to a unit controller 21 by leads 22. The unit controller is, in turn, connected to reversing valve 14 by a way of relay R1 and leads 23; the outdoor coil fan motor 34 by way of relay R2 and leads 26; and to the indoor coil fan motor 37 by way of relay R3 and leads 28. The outdoor fan is generally OFF during defrost operation. In addition, the unit controller 21 is electrically connected to an outdoor coil thermistor 31 by way of leads 29 and outdoor ambient air thermistor 32 by way of leads 30. Further, the unit controller 21 accumulates the time the coil is in defrost for use in adjusting subsequent defrost times.

The present invention is intended to optimize the efficiency of the defrost cycle by initiating each defrost cycle in accordance with an adjustable time-to-defrost function to thereby maintain an optimum period of defrost, and by initiating heat reclaim after defrost is terminated. In doing so, the operational parameters that are measured are the outdoor coil temperature, which is measured both before and after the defrost cycle by a thermistor 31, to provide an indication of refrigeration temperature, the outdoor ambient air temperature, which is continuously measured by a thermistor 32, to provide an indication of outdoor air temperature, and the time of each defrost to provide an adjustment to a linear portion of a defrost initiation curve. It has been found that each defrost should run no longer than ten (10) minutes, and that the optimum defrost time is between 5 and 9 minutes. This prevents initiating defrost too soon or allowing too much frost to build up on the coil between defrosts.

Figure 2:
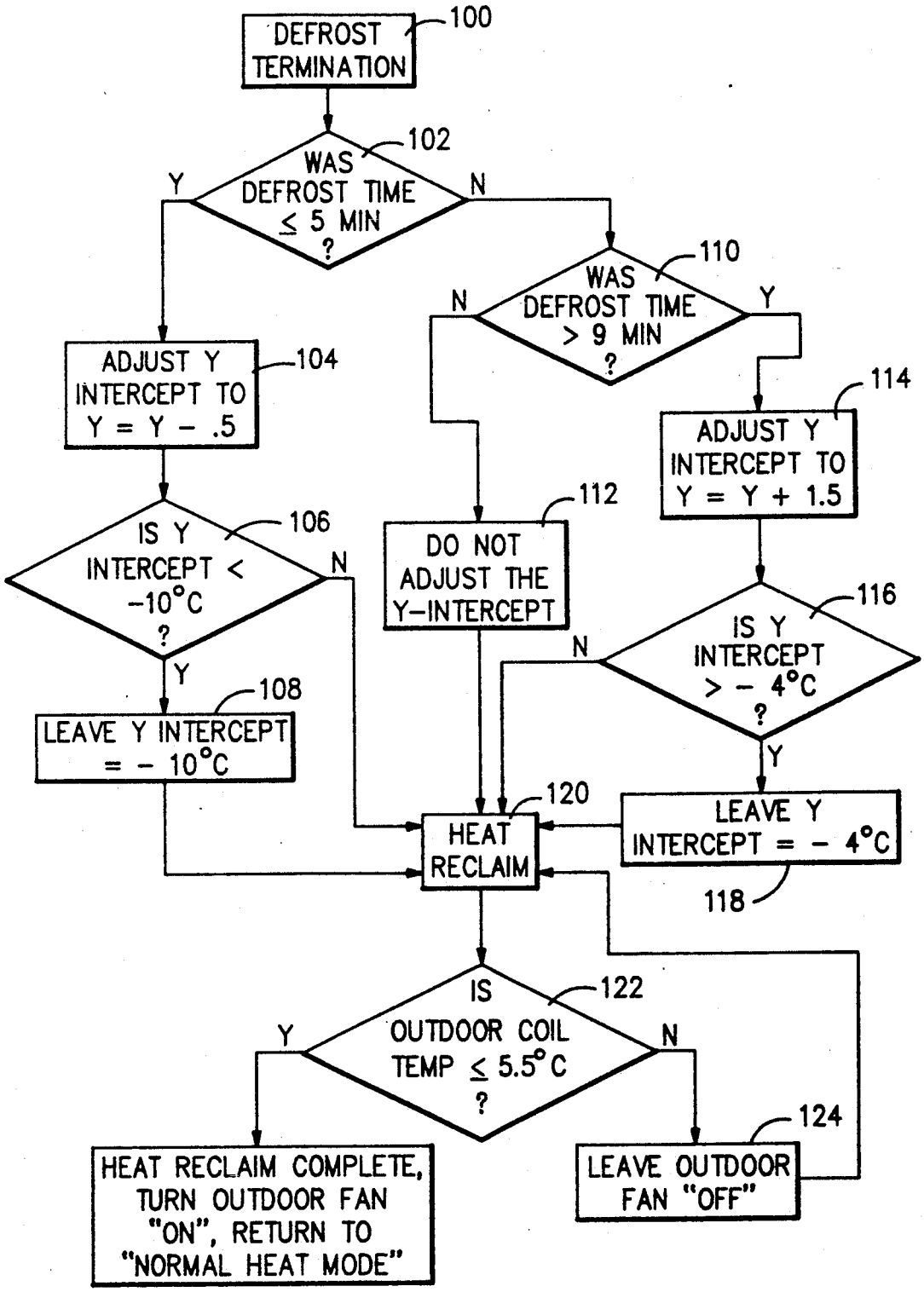
FIG. 2 is a flow diagram showing the sequence of steps to be performed in carrying out the adjustment of the period of time of defrost and the coil heat reclaim of present invention.

FIG. 2 shows the flow chart of the logic used to determine the adjustment to the time-to-initiate-defrost in accordance with the present invention, which in turn adjusts the length of the defrost. Prior to initiation of defrost the four-way valves are shifted from heat to defrost and outdoor fan is turned off. The flow chart includes defrost termination 100 from which the defrost is terminated and logic flows to step 102 to determine whether the outdoor coil was in defrost for less than or equal to 5 minutes. If the answer is YES, the logic proceeds to step 104 to adjust the ordinate intercept of curve "A" (shown in FIG. 3) down by 0.5° C. Adjusting curve "A" downward in accordance with the expression $Y_N = Y_P - 0.5°$ C. (where $Y_P$ is the ordinate intercept of the present defrost of curve "A" and $Y_N$ is the ordinate intercept for the next defrost) will make the next defrost occur later because the area of the defrost region under curve "A" has decreased. After the curve "A" is adjusted in step 104 the logic flows to step 106 to determine if the new ordinate intercept is less than −10.0° C. If the answer to step 106 is NO, the logic flows to step 120 to initiate heat reclaim by shifting the reversing valves 14 to the heating mode. If the answer to step 106 is YES, then the logic flows to step 108 and the ordinate intercept is clamped to its lower limit of −10.0° C., and heat reclaim of step 120 is initiated. If the answer to step 102 is NO, then the logic flows to step 110 to determine whether the outdoor coil was in defrost for greater than nine (9) minutes. If the answer to step 110 is NO, the logic flows to step 112 and curve "A" is not adjusted, and the logic then flows to step 120 to initiate heat reclaim. However, if the answer to step 110 is YES, then the logic flows to step 114 to adjust the ordinate intercept of curve "A" upwardly by 1.5° C. Adjusting the curve "A" upward in accordance with the expression $Y_N = Y_P + 1.5°$ C. (where $Y_P$ is the ordinate intercept of the present defrost of curve "A" and $Y_N$ is the ordinate intercept for the next defrost) will make the next defrost occur sooner because the area of the defrost region under curve "A" has increased.

After the curve "A" is adjusted in step 114 the logic flows to step 116 to determine if the ordinate intercept of curve "A" is greater than −4.0° C. If the answer to step 116 is NO, the logic flows to step 120 to initiate heat reclaim. If the answer to step 116 is YES, the logic flows to step 118 and the ordinate intercept is clamped to its upper limit of −4.0° C., and then heat reclaim of step 120 is initiated.

After the logic has flowed through step 120 to initiate heat reclaim it then proceeds to step 122 to determine whether the outdoor coil temperature is equal to or less than 5.5° C. If the answer is NO, the logic flows to step 124 and the outdoor fan 24 is kept OFF, and the logic flows back to step 120 which continues heat reclaim which is heat mode except the outdoor fan 24 is OFF. If the answer is YES, the logic proceeds to step 126 to terminate heat reclaim and turn the outdoor fan 24 back ON and return the system to the normal heat mode.

Figure 3:
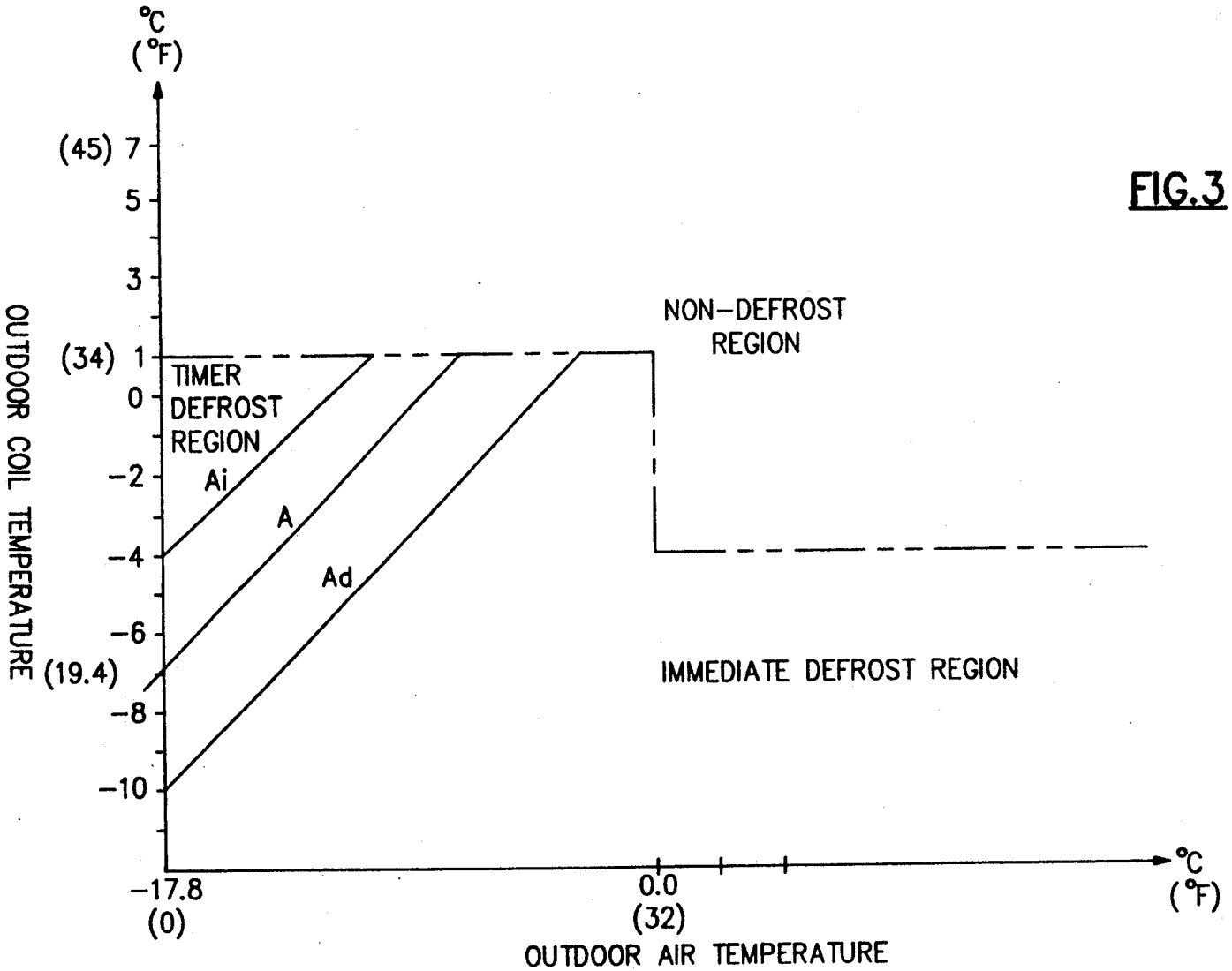
FIG. 3 is a graphic illustration of an envelope with an adjustable first linear portion and fixed portions plotted as a function of outdoor ambient air temperature and the temperature and the outdoor coil temperature of the present invention.

Defrost is regulated generally as shown in FIG. 3. The defrost region is shown as a function of outdoor coil temperature and outdoor air temperature. Defrost in only initiated when operating in the heating mode and when the temperature parameters are either in the Time Defrost Region or the Immediate Defrost Region. Defrost will not be initiated if the outdoor coil temperature is greater than 34° F. (+1.1° C.) and the outdoor air temperature is less than 32° F. (0.0° C.), or if the outdoor coil temperature is greater than 24.8° F. (−4.0° C.) and the outdoor air temperature is greater than 32° F. (0.0° C.). These regions are the Non-Defrost Region. If the coil temperature is above the reference level curve "A", (The Timer Defrost Region), defrost automatically occurs after six (6) hours of compressor run time but if the coil temperature is below curve "A", the coil is immediately defrosted if the compressor has been running for thirty (30) minutes since the last defrost. However, in accordance with the present invention, the reference level curve "A" as determined by empirical data and expressed as: Outdoor Coil Temperature ($T_c$) (°F)=4/5 Outdoor Air Temperature (To) (°F)+ordinate intercept, where the ordinate intercept is adjustable from −4.0° C. to −10.0° C. If the reference curve "A" is shifted upward (to $A_i$) because the next previous defrost mode had terminated in greater than nine (9) minutes, the next subsequent defrost will occur sooner because the previous defrost had not completely cleaned the outdoor coil. Conversely, if the previous defrost mode had terminated in five (5) minutes or less, then the reference curve "A" will shift downward to $A_d$, so that the next subsequent defrost will occur later because the previous defrost had defrosted the coil unnecessarily.

While the present invention has been described in detail with reference to the illustrative embodiments, many modifications and variations would present themselves to those skilled in the art.

What is claimed is:

1. A method of adjusting a defrost region curve for determining the initiation of a next subsequent defrost cycle for removing accumulated frost from an outdoor heat exchanger coil including an outdoor fan forming a portion of a refrigerant heat pump system comprising the steps of:

initiating a defrost cycle upon comparing the comparison between outdoor ambient temperature and outdoor heat exchanger coil refrigerant temperature with a defrost initiation reference level curve:

terminating said defrost cycle;

determining the length of time of said defrost cycle;

adjusting the defrost initiation reference level curve for the initiation of the next subsequent defrost cycle when said defrost cycle is outside a predetermined time period; and operating a heat reclaim cycle, with the outdoor fan deenergized until the outdoor heat exchanger coil refrigerant temperature reaches a predetermined temperature.

2. A method as setforth in claim 1 wherein the step of initiating a defrost cycle is calculated by solving the temperature equation for the defrost initiation reference level curve: $T_c=4/5\ T_o+Y$, where $T_c$ is the outdoor heat exchanger coil refrigerant temperature, $T_o$ is the outdoor ambient temperature and Y is an ordinate intercept of the outdoor heat exchanger coil refrigerant temperature.

3. A method as setforth in claim 2 wherein the step of adjusting said defrost initiation reference level curve includes adjusting the ordinate intercept (Y) upwardly by 1.5° C. when said length of time of said defrost cycle is greater than nine minutes and adjusting the ordinate intercept downwardly by 0.5° C. when said length of time of said defrost cycle is less than or equal to five minutes.

4. A method as setforth in claim 3 wherein the predetermined temperature for operating the heat reclaim cycle is less than or equal to 5.5° C.

5. A method of adjusting the length of time of a next subsequent defrost cycle of removing accumulated frost from an outdoor heat exchanger coil including an outdoor fan forming a portion of a refrigerant heat pump system comprising the steps of:

initiating a defrost cycle upon comparing the comparison between outdoor ambient temperature and outdoor heat exchanger coil refrigerant temperature with a defrost initiation reference level, wherein the defrost initiation reference level is calculated by solving the temperature equation: $T_c=4/5\ T_o+Y$, where $T_c$ is the outdoor heat exchanger coil refrigerant temperature, $T_o$ is the outdoor ambient temperature and Y is an ordinate intercept of the outdoor heat exchanger coil refrigerant temperature;

terminating the defrost cycle;

determining the length of time of the defrost cycle;

adjusting the defrost initiation reference level for the initiation of the next subsequent defrost cycle when said defrost cycle is outside a predetermined time period, wherein the adjustment of the defrost initiation reference level includes adjusting the ordinate intercept (Y) upwardly by 1.5° C. when said length of time of the defrost cycle is greater than nine minutes and adjusting the ordinate intercept downwardly by 0.5° C. when said length of time of the defrost cycle is less than or equal to five minutes; and operating a heat reclaim cycle with the outdoor fan deenergized until the outdoor heat exchanger coil refrigerant temperature is less than or equal to 5.5° C.

6. A method as setforth in claim 5 further including the step of energizing said outdoor fan and initiating normal heat mode upon reaching the predetermined temperature.

* * * * *